United States Patent [19]

Sanderson

[11] 4,014,242

[45] Mar. 29, 1977

[54] APPARATUS FOR USE IN THE TUNING OF MUSICAL INSTRUMENTS

[75] Inventor: Albert E. Sanderson, Carlisle, Mass.

[73] Assignee: Inventronics, Inc., Carlisle, Mass.

[22] Filed: May 22, 1975

[21] Appl. No.: 579,946

Related U.S. Application Data

[63] Continuation of Ser. No. 399,923, Sept. 24, 1973, abandoned, which is a continuation-in-part of Ser. No. 249,942, May 3, 1972, abandoned.

[52] U.S. Cl. ..... 84/454; 324/79 D

[51] Int. Cl.[2] ..... G10G 7/02

[58] Field of Search ..... 84/1.01, 454; 324/79 R, 324/79 D; 73/67.2, 559

[56] References Cited

UNITED STATES PATENTS

| | | | |
|---|---|---|---|
| 2,924,776 | 2/1960 | Peterson | 324/79 R |
| 2,958,250 | 11/1960 | Poehler | 84/454 |
| 3,509,454 | 4/1970 | Gossel | 84/1.01 |
| 3,696,293 | 10/1972 | Hoffmann et al. | 324/79 D |
| 3,722,353 | 3/1973 | Westhaver | 324/79 R |
| 3,766,818 | 10/1973 | Prohofsky | 324/79 R |
| 3,901,120 | 8/1975 | Youngquist | 84/454 |

*Primary Examiner*—Ulysses Weldon
*Attorney, Agent, or Firm*—Cesari and McKenna

[57] ABSTRACT

A musical tuning aid. The tuning aid generates a digital note signal at the frequency of a selected partial of a note being sounded and combines this note signal and a four-phase digital clock output having a reference frequency to produce four output signals which low-pass filters convert to dc output signals. Each output signal indicates the instantaneous phase difference between the note and a respective one of the clocking signals.

Each dc output output signal controls the light from a pair of lamps. Individual lamps in each pair are diametrically opposed on a circle with all the pairs being equiangularly spaced. The lamp pairs reach maximum brightness in sequence, providing the illusion of a rotating light bar. The direction of rotation indicates whether the note being tuned is flat or sharp and the speed of rotation is proportional to the frequency deviation from the reference.

24 Claims, 8 Drawing Figures

APPARATUS FOR USE IN THE TUNING OF MUSICAL INSTRUMENTS

CROSS REFERENCE TO RELATED APPLICATION

This patent application is a continuation of U.S. patent application Ser. No. 399,923 filed Sept. 24, 1973 now abandoned which in turn is a continuation-in-part application of U.S. patent application Ser. No.. 249,942 filed May 3, 1972, now abandoned.

BACKGROUND OF THE INVENTION

This invention generally relates to tuning musical instruments and more specifically to apparatus which simplifies tuning procedures.

Conventionally, a person listens to a reference note and adjusts a musical instrument until its note seems consonant with the reference note. Consciously, or not, the person tunes a note for a zero beat with the reference note, usually at some coincident harmonic or partial of either one or both the notes.

This type of tuning, known as Interval Tuning, is possible because a conventional scale is based upon mathematical relationships. In practice, however, pianos and other stringed instruments do not follow simple mathematical rules. The overtones, or partials, generated by a given note are more than integral multiples of the fundamental. This deviation, termed "stretch", may be defined as the difference between a partial and corresponding harmonic (e.g., the second partial and theoretical second harmonic frequency) or a note. Stretch is significant. In a piano, for instance, the second partial from a string averages 2.002 to 2.006 or more times the fundamental frequency. Thus, if the fundamental notes are tuned mathematically, stretch causes a piano to sound out of tune.

Therefore, pianos and similiar instruments must be tuned differently. The general approach is a complex, iterative process in which a tuner tries to reduce errors to a minimum step-by-step. Basically, a piano tuner starts tuning a piano in a "temperament octave" by adjusting a first note to a reference frequency. He adjusts the remaining notes in the temperament octave by listening to partials of third, fourth and fifth intervals. For example, in striking an interval of a third with a previously tuned lower note, the tuner adjusts the upper note while listening to the beat between the fifth partial of the lower note and the fourth partial of the upper note. He assumes the proper relationship exists when he obtains a predetermined beat frequency between these coincident partials.

Listening to these partials reduces errors at the fundamental frequency becuase the partial errors are multiplied in terms of actual frequency differences. That is, a 4 Hz error at the fourth partial represents only a 1 Hz error at the fundamental. Also, the use of partials inherently tends to compensate for piano stretch. However, the process is not perfect and the tuner usually checks the temperament using different intervals and retunes it as necessary to minimize the tuning errors.

Once the tuner completes the temperament octave, he tunes other notes by comparing partials while playing octave intervals. He may, for example, listen to the beat between the fourth partial of a lower, tuned note and the second partial of the upper note while adjusting string tension for the upper note. Lower notes are tuned similarly.

Most piano notes have two or three strings. During the foregoing interval timing procedure, the tuner damps out strings so only one string actually sounds when a hammer strikes all the strings associated with that note. After the tuner completes the interval tuning procedure, he must tune the other strings for each note to be in unison with the first string comparing corresponding partials of two strings associated with a given note.

As may be apparent, however, the entire procedure requires that a note sustain long enough to enable the tuner to determine the beat frequency. Obviously, the longer the interval the note sustains, the more accurately the tuner can determine the beat frequency. In tuning, each note struck sounds until it dies out naturally or the key is released. By "dying out", I mean that the note can no longer be heard.

Although there are several tuning aids, no one aid has wide acceptance. In one, a high frequency oscillator produces an output clock signal at a selected frequency. A series of frequency dividers and an octave selector switch provide a means for generating a reference signal at a selected subharmonic frequency. The tuning aid combines this reference signal and an audio signal representing the note being tuned either to generate an audible beat note or to deflect a pointer on an indicating meter. Unfortunately, those aids lose accuracy as the tuned note comes into frequency with the reference. When the beat rate decreases below 20 Hz and especially 1 Hz, the audible beat note becomes inaudible. Similarly, an indicating meter uses a frequency-to-current converter so the current level goes to zero at a zero beat. As the current approaches zero, the visual indication becomes less accurate. Both types of display, therefore, lose accuracy at the very time it is most necessary.

In another unit, the tuner attaches a piezoelectric transducer to a particular string or a sounding board to produce a corresponding electrical signal that is applied to the vertical deflection plates of a cathode ray tube. A selector switch, crystal controlled oscillator and a series of frequency dividers generate a selected reference signal which energizes the horizontal deflection plates of the tube. In using this circuit, one apparently assumes, erroneously, that a piano generates a constant, repetitive wave form. In fact, a piano string generates an extremely complex wave form with a fundamental frequency and partials slightly out of tune with each other but often of the same magnitude. Furthermore, the component frequencies are not necessarily constant in relative magnitude because a string vibrates in many modes, each with its own damping constant. These factors cause the waveform to change continuously, so the display is difficult to interpret.

Another problem relates to dynamic response. Initially, the amplitude of the signal is sifficient to drive the display off the screen. As the tone dies out, the input to the vertical deflection plates falls below the minimum level necessary for generating a usable display. An obvious solution is installing a variable gain amplifier to maintain the output at a constant value. However, a circuit which provides satisfactory results over the wide range of conditions and waveforms which the piano generates is difficult to attain in practice. If the variable gain circuit actually tracks the decay, it may follow the waveform and provide a dc output signal. Therefore, this solution is not practicable especially in view of the non-linear parameters or conditions and the short interval for a readable display. This effective dynamic range further complicates tuning because adjusting a string while monitoring the display is very difficult.

Still another tuning aid receives the audio signal from a piano and generates a corresponding electrical signal to energize the blanking or Z axis circuitry of a cathode ray tube. A circular generator energizes X and Y axis deflection plates with a reference frequency so the electron beam describes a circle on the screen. If a note is in tune with the reference, the audio signal blanks and unblanks the electron beam during the same part of each revolution to thereby display one arcuate segment. A second harmonic input signal produces two such arcuate segments; a third harmonic input signal, three segments; and so forth. If a given note is not exactly harmonically related to the reference, the segments rotate. The direction of rotation indicates whether the note is sharp or flat while the speed of rotation indicates the difference in frequencies. As notes in the upper piano produce a display with a number of segments, the spaces between adjacent sectors diminish; and the absolute frequency deviation which produces a persistent display tends to decrease. Furthermore, alternately blanking and unblanking the beam produces an indefinite segment termination on the screen. When the frequency deviation is small, the indefinite termination makes it difficult to determine whether the edges of the segment are moving. When notes in the lower range of the piano are tuned, the tuner must try to adjust while the tuning aid responds to harmonics, since subharmonics of the reference frequency generate complete circles on screen.

Apparently, another reason professional piano tuners are reluctant to use prior aids is that each piano is tuned uniquely, so a generalized tuning aid that responds to the fundamental frequency of the note being tuned does not really help the tuner. The unique quality of each piano stems from its construction, string length, wear on hammers, and myriad other factors. As a result, piano tuners continue to work conventionally and do not place any significant reliance on mechanical aids.

Therefore, it is an object of my invention to provide a tuning aid which is readily adapted for tuning a wide variety of instruments.

SUMMARY

In accordance with my invention, a tuner selects a specific note and a specific octave on the tuning aid. He strikes a note. A microphone picks up the sound, and a filter passes only the selected frequency. The tuning aid converts the signal to a square-wave note signal. A reference clock provides an output which is converter to a multi-phase reference signal. The tuning aid compares the note signal against each reference phase signal to generate multiple pulse signals with the pulse width of each representing the phase difference between the note signal and a respective one of the phase reference signals.

Other circuitry converts these pulse signals to multiple dc signals which individually energize different lamps. The lamps may be equiangularly spaced on a circumference with lamps in diametrically opposed pairs. The magnitude of the dc signals are normally proportional to the respective pulse widths. Accordingly, when a note signal is in phase with one of the phase reference signals, one pair of lamps is at maximum brightness. Any frequency deviation causes pairs of lamps to reach full brilliance in succession, so the display looks like a rotating light bar. The direction of rotation indicates the direction of deviation while the speed or rotation indicates the magnitude of the deviation.

This invention is pointed out with particularity in the appended claims. A more thorough understanding of the above and further objects and advantages of this invention may be attained by referring to the following description taken in conjunction with the accompanying drawings.

DESCRIPTION OF AN ILLUSTRATIVE EMBODIMENT

1. General Discussion

Figure 1:
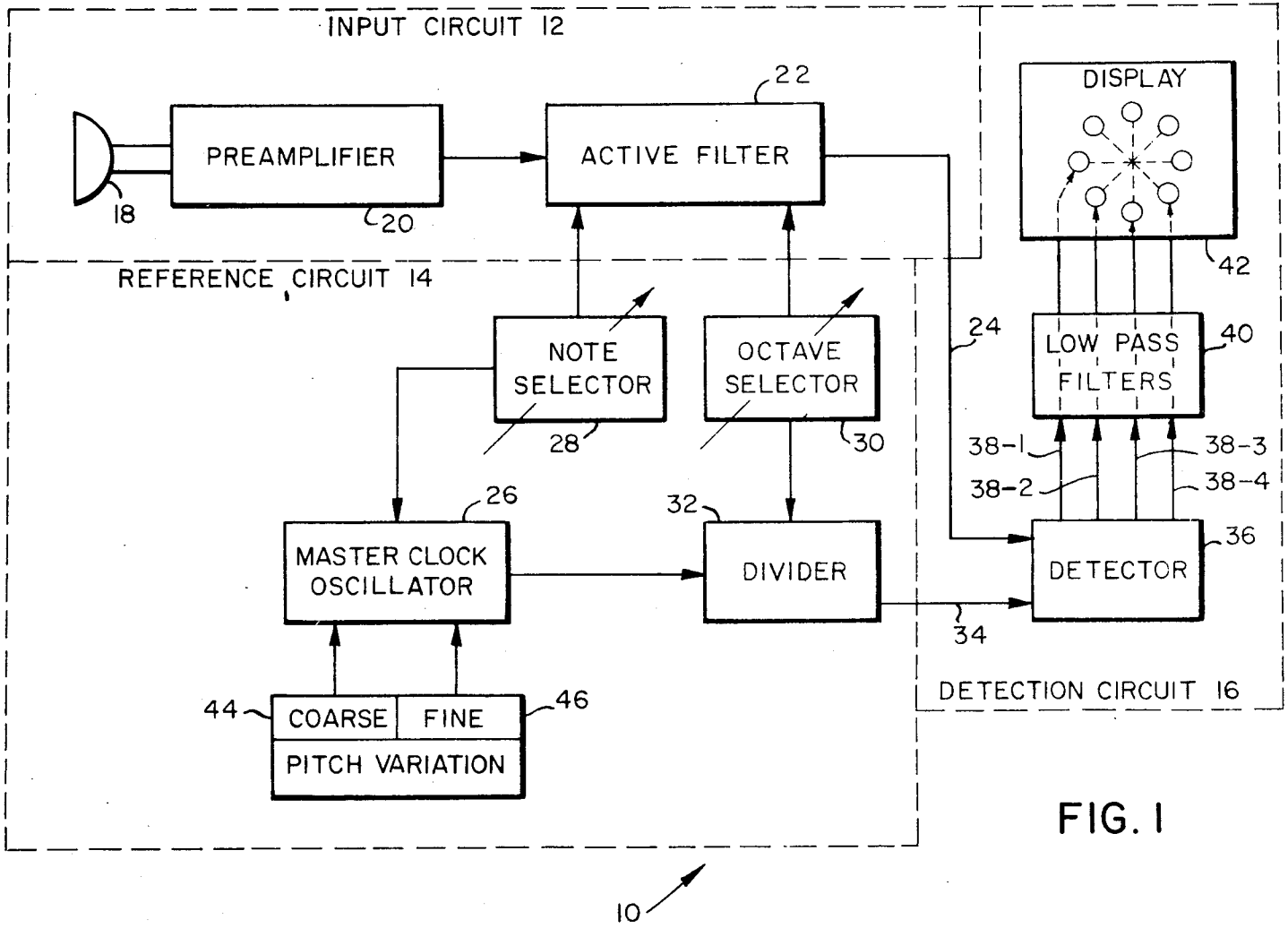
FIG. 1 is a block diagram of a tuning aid constructed in accordance with my invention.

As shown in FIG. 1, my tuning aid 10 comprises an input circuit 12 and a comparison and display circuit including a reference circuit 14 and a detection circuit 16. The input circuit 12 includes a microphone 18 which picks up signals generated as a musical instrument is tuned. For example, on a piano, it detects the sound emanating from a struck note. A conventional preamplifier 20 and an active filter 22 isolate the signal being tuned from other signals which the microphone 18 senses (i.e., an active bandpass filter). The filter 22 preferably is a tunable filter which has a quality factor greater than 10. Such bandpass filters are known in the art. The filter 22 produces an audio output signal on a conductor 24 which connects to the detection circuit 16.

The reference circuit 14 produces a second input signal to the detection circuit 16. A variable frequency master clock oscillator 26 covers the 12 notes two octaves above the highest octave to be tuned, for purposes which will become apparent later. A particular oscillator frequency is selected by a note selector 28 in the form of a two-pole switch which simultaneously tunes the active filter 22 by changing one or more tuning resistors therein. An octave selector 30 also controls the active filter 22 by changing capacitors therein and is in the form of a three-pole switch. The selector 30 further controls a frequency divider 32 which, in response to the signals from the master clock oscillator 26, provides a square wave output signal which is twice the frequency determined by the note selector 28 and octave selector 30. That is, if the selectors 28 and 30 are set to select a musical A at 440 Hz [hereinafter A(440)], resistors and capacitors in the filter 22 tune it to a center frequency of 440 Hz while the master clock oscillator 26 generates a 28.16 kHz output and an 880 Hz signal appears on the counductor 34 leading from the divider 32.

The detection circuit 16 has a detector 36 which receives both the audio signal on the conductor 24 and the reference signal on the conductor 34. It generates four output signals on output conductors 38-1, 38-2, 38-3, and 38-4. Each output is a constant-amplitude, pulse-width-modulated signal with pulse width varying as a function of the phase difference between a note signal on the conductor 24, derived from the instrument being tuned, and a reference signal on the conductor 34, which is the output from the clock divider 32. The pulse repetition rate is equal to the selected reference frequency and the rate at which the pulse width changes on each conductor depends on the frequency difference between the note frequency and one-half the reference frequency, the pulses on each conductor having unvarying width if the struck note is in tune with the reference. Low-pass filters 40 couple the pulse signals from the detector 36 to a display 42. At any given time a filtered dc output is proportional to the width of an input pulse. If there is a frequency deviation, each low-pass filter output varies up and down between 0 to 200% of its normal value at a rate which is proportional to the frequency difference.

The display unit 42 preferably contains an array of lamp means in which one pair of lamps (e.g., light-emitting diodes) is energized by each low-pass filter output. Mechanically, each lamp in a pair may be diametrically opposed in a circle, with adjacent lamp pair separated by 45°. As becomes apparent later, the signals which energize lamps in space quadrature are 180° out of phase electrically. If a first lamp pair is at full brilliance, a second lamp pair, displaced 90° from the first, is off. The lamp pairs that are displaced ±45° from the first are also off, for reasons I discuss later.

When an incoming note is in tune, one pair of lamps may be at or nearly at full brilliance or two pairs may be partially lit. However, the relative brilliance of the lamps does not change. As a result, the display appears stationary. If there is a frequency difference, the individual lamp pairs reach full brilliance in one of two sequences. If the note is "sharp" (i.e., at a higher frequency than one-half the reference frequency). then the lamps reach full brilliance in a clockwise sequence; so the display appears to rotate clockwise. When a note is flat, the sequence is reversed and the display appears to rotate counterclockwise. As the repetition rate at which a given set of lamps reaches full brilliance depends upon the frequency difference, the rate at which the display appears to rotate indicates the magnitude of the difference.

2. Specific Discussion

The heart of this invention is in the manner in which the detector 36 and low-pass filters 40 condition input signals and display the results. Still referring to FIG. 1, the signal the master clock oscillator 26 and the divider 32 place on conductor 34 has twice the frequency of the selected note. Division by at least two in the divider 32 means that the frequency of the output signal from the master clock oscillator 26 must be four times the highest frequencies to be measured. In one specific embodiment using a C as a lower octave limit and a B as an upper limit, the master clock oscillator 26 generates nominal signals in the range between 16744 and 31609 Hz. Depending on the setting of the octave selector 30, the clock divider 32 divides the oscillator output by a factor of $2^n$ where $1 \leq n \leq 8$. When the octave selector 30 is set for the highest octave, the divider 32 divides the oscillator frequency by 2, while division by 256 occurs when the octave selector 30 is set for the lowest octave. As a specific example, setting the note selector 28 to A causes the oscillator 26 to generate a 28160 Hz signal. The frequency of the signal on the conductor 34 and the frequency which the tuning aid will sense are then as follows:

| Octave Number | Signal on Conductor 34 | Frequency of Signal Being Measured |
|---|---|---|
| 8 | 14,080 | 7,040 |
| 7 | 7,040 | 3,520 |
| 6 | 3,520 | 1,760 |
| 5 | 1,760 | 880 |
| 4 | 880 | 440 |
| 3 | 440 | 220 |
| 2 | 220 | 110 |
| 1 | 110 | 55 |

a. Detection Circuit 16

Figure 2:
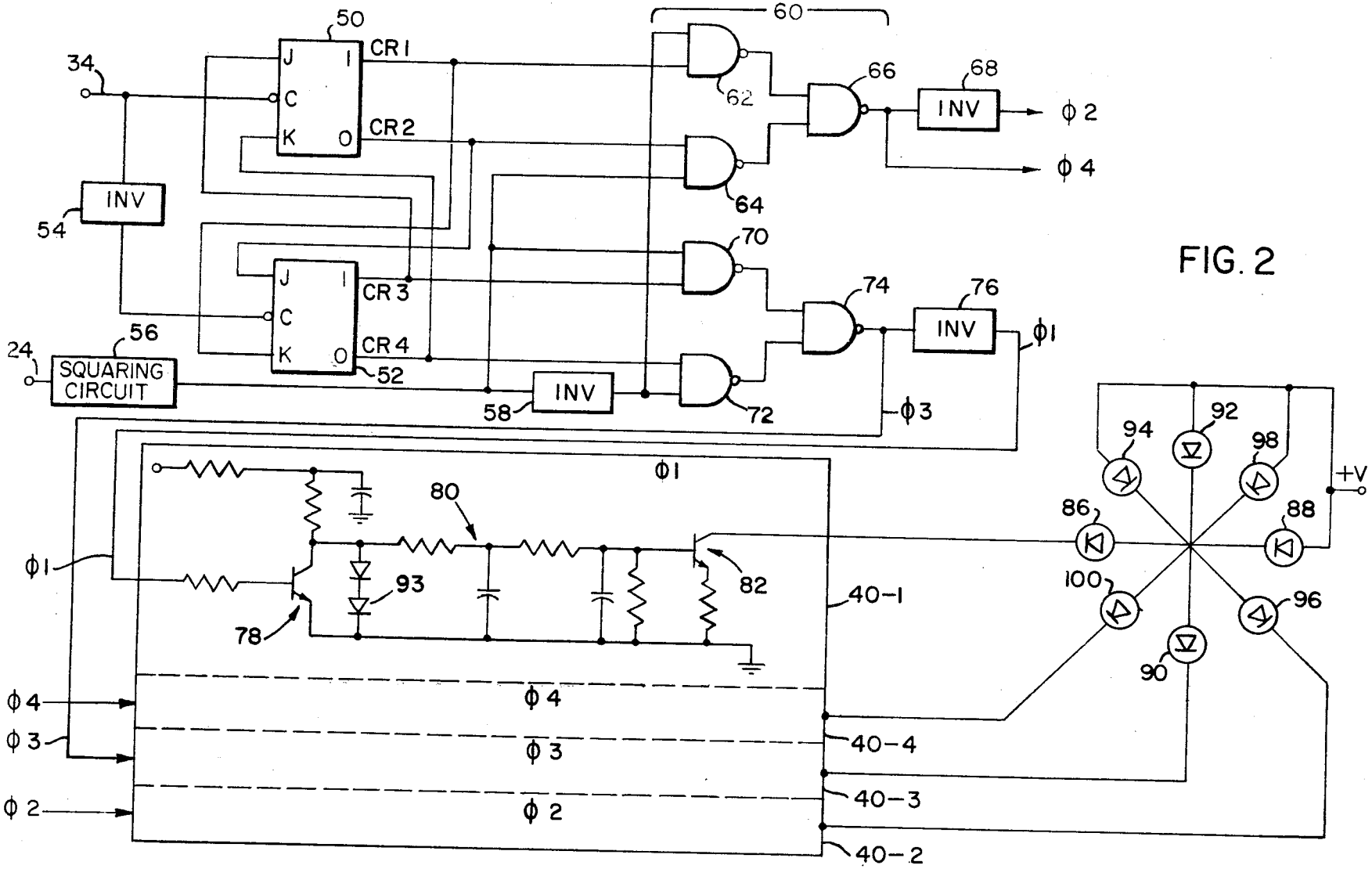
FIG. 2 is a circuit schematic which illustrates certain details of the circuit shown in FIG. 1.

Now referring to FIG. 2, the signal on conductor 34 energizes the inverting clocking terminals of JK flip-flops 50 and 52, the latter clocking input receiving its signal from an inverter 54. The nature of the cross-coupling shown in FIG. 2 determines the flip-flop response to clocking signals. In this particular embodiment, the JK flip-flop 50 and 52 are cross-coupled so the set (1) and reset (0) output terminals of the JK flip-flop 50 energize the K and J input terminals of the JK flip-flop 52, respectively. The set (1) and reset (0) output terminals of the JK flip-flop 52 connect to the J and K input terminals of the flip-flop 50, respectively.

Figure 3:
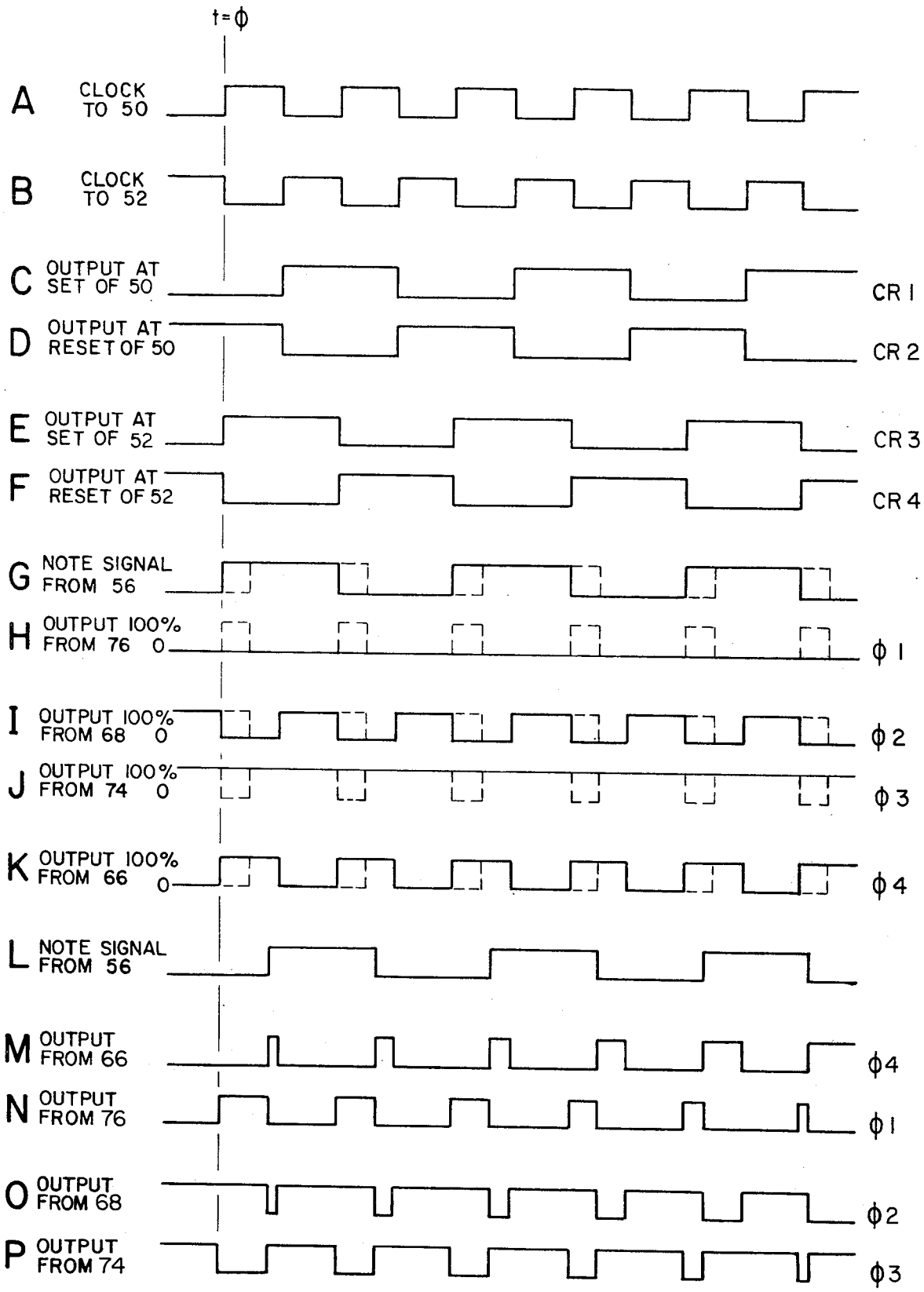
FIG. 3 is a graphical analysis of the operation of a portion of the circuit shown in FIG. 1.

Now referring to FIG. 3, GRAPH A represents the binary clocking signal, a square wave that energizes the JK flip-flop 50 while GRAPH B is a timing chart for the complementary clocking signal to the flip-flop 52 from the inverter 54. Assuming for a moment that at $t=0$ the complementary clocking signal to the flip-flop 52 falls while both the flip-flop 50 and 52 are reset, the trailing, or falling, edge of the complementary clocking signal sets the flip-flop 52 and generates a clock reference signal designated as CR3 and a complement CR4 signal as shown in GRAPHS E and F. Next, the trailing edge of the clocking signal sets the flip-flop 50, which generates the CR1 and CR2 signals as shown in GRAPHS C and D. A succeeding complementary clocking signal to the flip-flop 52 resets it (GRAPHS E and F). This conditions the flip-flop 50 to be reset by the trailing, or falling, edge of its next clocking signal. As a result, it takes two cycles of the clocking signal from the conductor 34 to cycle each CR signal from the flip-flops 50 and 52. This additional frequency division means the given plurality of four CR signals from the flip-flops 50 and 52 each are at the selected frequency. As also apparent, the CR signals are in quadrature. Looking at the positive-going pulse edges, the sequence is CR3-CR1-CR4-CR2, the leading edge of each pulse being spaced 90° in phase from the leading edges of preceding and following pulses. Hence, the outputs of flip-flops 50 and 52 constitute means for generating a given plurality of spaced phase reference signals at a known frequency.

GRAPH G depicts a binary note signal after the signal on the conductor 24 is conditioned in a conventional squaring circuit 56 in FIG. 2. In this particular example, the note is in tune with the reference selected frequency and the signal in solid lines is in phase with the CR3 signal. In addition, an inverter 58 produces a complementary note signal which is in phase with the CR4 signal.

Referring to FIGS. 2 and 3, the binary four-phase clock reference signals and the binary note signal energize a phase modulator circuit 60 which combines the note signal and each clock reference signal logically. Although logical AND and other logical combinations are adapted for use in this invention, very good results are obtained with a circuit 60 comprising two exclusive OR circuits. The first exclusive OR circuit comprises NAND circuits 62, 64 and 66; the second, NAND circuits 70, 72 and 74. The outputs from a NAND circuit 66 is designated as the $\phi 4$ output; the complementary $\phi 2$ output comes from the inverter 68. There are two conditions which cause the $\phi 4$ output signal to be at a zero level representing a FALSE output from the exclusive OR circuit:

1. the binary note signal is positive and CR1 is positive, or
2. the binary note signal is zero and CR1 is zero. Otherwise the $\phi 4$ signal is at a ONE level indicating that the exclusive OR function is met.

Similarly, the $\phi 3$ signal is ZERO when:

1. the binary note signal is positive and CR4 is positive or
2. the binary note signal is zero and CR4 is zero. Otherwise the $\phi 3$ signal is at a ONE level.

Therefore, the $\phi 4$ output signal indicates whether the CR1 signal (the set condition of the flip-flop 50) and the binary note signal satisfy an exclusive OR condition. Similarly, the $\phi 1$, $\phi 2$ and $\phi 3$ signals indicate the exclusive OR condition of the binary note signal and each of the CR3, CR2 and CR4 signals, respectively.

Still referring to FIGS. 2 and 3 and considering the binary note signal shown by the solid line in GRAPH G, the note signal and set output from the flip-flop 52 are exactly in phase. Either the NAND circuit 70 or 72 keeps the $\phi 3$ output signal at a positive or logic 1 value, so the $\phi 3$ signal has a 100% duty cycle. Obviously, the $\phi 1$ output signal is always at a logic zero or a minimum value and has a 0% duty cycle. On the other hand, the necessary conditions to shift the $\phi 4$ output signal to a positive state exist 50% of the time, so the $\phi 4$ and $\phi 2$ output signals are complementary pulse trains at twice the selected frequency and each has a 50% duty cycle.

Now referring back to FIG. 2, each phase-modulated output signal is passed through one of four identical energizing circuits such as low-pass filter circuits 40, a $\phi 1$ filter circuit 40-1 being shown in detail. A switching circuit 78 together with diodes 93 is responsive to the $\phi 1$ output signal and provides a constant amplitude, variable width pulse input to a conventional two-section RC low-pass filter 80. The low-pass filter 80 normally varies its output voltage as a function of the duty cycle to control a non-linear lamp amplifier 82 which in turn, energizes light-emitting diodes 86 and 88.

In the particular situation shown by GRAPH G in FIG. 3, the $\phi 1$ output signal (GRAPH H) is constant at zero (a 0% duty cycle). This places a maximum positive voltage on the base electrode of the transistor amplifier 82, so the amplifier 82 keeps the diodes 86 and 88 on; and they generate a maximum light output. However, the $\phi 3$ output signal (GRAPH J) and the output of the $\phi 3$ filter circuit 40-3 are at maximum and minimum levels respectively, so diodes 90 and 92 are turned off.

On the other hand, the $\phi 2$ and $\phi 4$ output signals (GRAPHS I and K) have a 50% duty cycle. In order to enchance the display, the filters are constructed so the lamps in a pair do not light until the duty cycle of an output signal falls below some threshold reprsenting a duty cycle less than 50%. Specifically, the diodes 93 in the switching circuit 78 clip the input signal to a value which equals the forward breakdown voltage of two diodes (i.e., about 1.2 volts total with silicon diodes). The low-pass filter 80 is constructed so that at approximately a 50% duty cycle, the filter output cannot forward bias the base-emitter junction of the amplifier 82 so the light-emitting diodes that the amplifier controls do not conduct. When the duty cycle reaches a value which causes the filter output to forward bias the base-emitter junction, the amplifier 82 turns on and the corresponding diodes conduct whereupon the diodes emit light at a level which is proportional to the current through the amplifier.

If the note signal shown in GRAPH G merely shifts slightly in phase, without changing frequency, as shown by the dotted lines, the $\phi 1$ output signal no longer has a 0% duty cycle signal. Hence, the energizing current through the diodes 86 and 88, which responds to the duty cycle for the $\phi 1$ output signal, decreases. If the phase-shift is to the right as shown by the dashed lines in GRAPH G, the $\phi 2$ output signal duty cycle increases, so diodes 94 and 96 remain off. In this particular case, the $\phi 3$ duty cycle decreases, but remains above a 50% duty cycle, so the diodes 90 and 92 also remain off. However, the $\phi 4$ signal has a duty cycle which is less than 50% so the diodes 98 and 100 turn on slightly.

GRAPH L shows the signal from the squaring circuit 56 when the note signal frequency is greater than the standard frequency. GRAPHS C through F and L show that each output signal duty cycle varies in time depending upon the phase relationship between the note signal and correspondng phase reference signal. For the time interval shown, it is apparent from GRAPH M that the $\phi 4$ duty cycle is increasing from a minimum. Meanwhile, the duty cycle of the $\phi 2$ output signal (GRAPH O) is decreasing from a maximum. As time continues, the $\phi 4$ output signal will reach a maximum duty cycle and then return to a minimum; and the variation is substantially linear with time. Similarly, the duty cycle of $\phi 1$ output signal (GRAPH N) is decreasing from 50% while the $\phi 3$ output signal (GRAPH P) is increasing from 50%. As a result, the light output from diodes 98 and 100 decreases while diodes 86 and 88 turn on with their brightness increasing as the duty cycle of the $\phi 1$ signal continues to decrease.

Furthermore, the light output from diodes 98 and 100 continues to decrease until the threshold is reached, whereupon they turn off. At about the time they reach one-half brilliance, however, the output from the filter circuit 40-1 will have reached the same value, so that diodes 86 and 88 will also be at about half brilliance. When the diodes 86 and 88 reach full brilliance, the tuner sees what appears to have been a rotation of a light bar 45° clockwise and this apparent rotation continues, so that the display appears as a bar which rotates at one-half the beat frequency.

When the beat frequency exceeds about 5 to 10 Hz, the display becomes persistent to the eye. However, at this beat frequency, each low-pass filter begins to attenuate its output so the maximum current level, and the average energy level to the lamps, decreases. This reduces the average brilliance of the lamps. So when the display is persistent, the tuner adjusts a piano string to increase brilliance. At about 25 Hz, there is enough filter attenuation to turn all the lamps off. This poses no problem, however, because a 25 Hz difference is readily detectable by ear. At the low end of the piano, it represents an octave while at the high end of the piano, it represents a tuning error of 10% of a semitone.

It is apparent that the individual input pulses to each of the filter circuits, such as the filter 80 in filter circuit 40-1, do not affect directly the light emitting diodes. This is because the pulses themselves are at the frequency of the reference signal which is always greater than the cut-off frequency for the low-pass filters.

b. Master Clock Oscillator 26

For the tuning aid to be effective, there should be some provision to vary the frequency of the master clock oscillator shown in FIG. 1. The oscillator 26 generates signals in accordance with the known mathematical relationships of the equally tempered scale. Coarse and fine pitch variation controls 44 and 46 (FIG. 1) enable a tuner to vary the frequency of all the notes up to one-half a semi-tone in either direction, while preserving the correct relationship among the notes.

Figure 4:
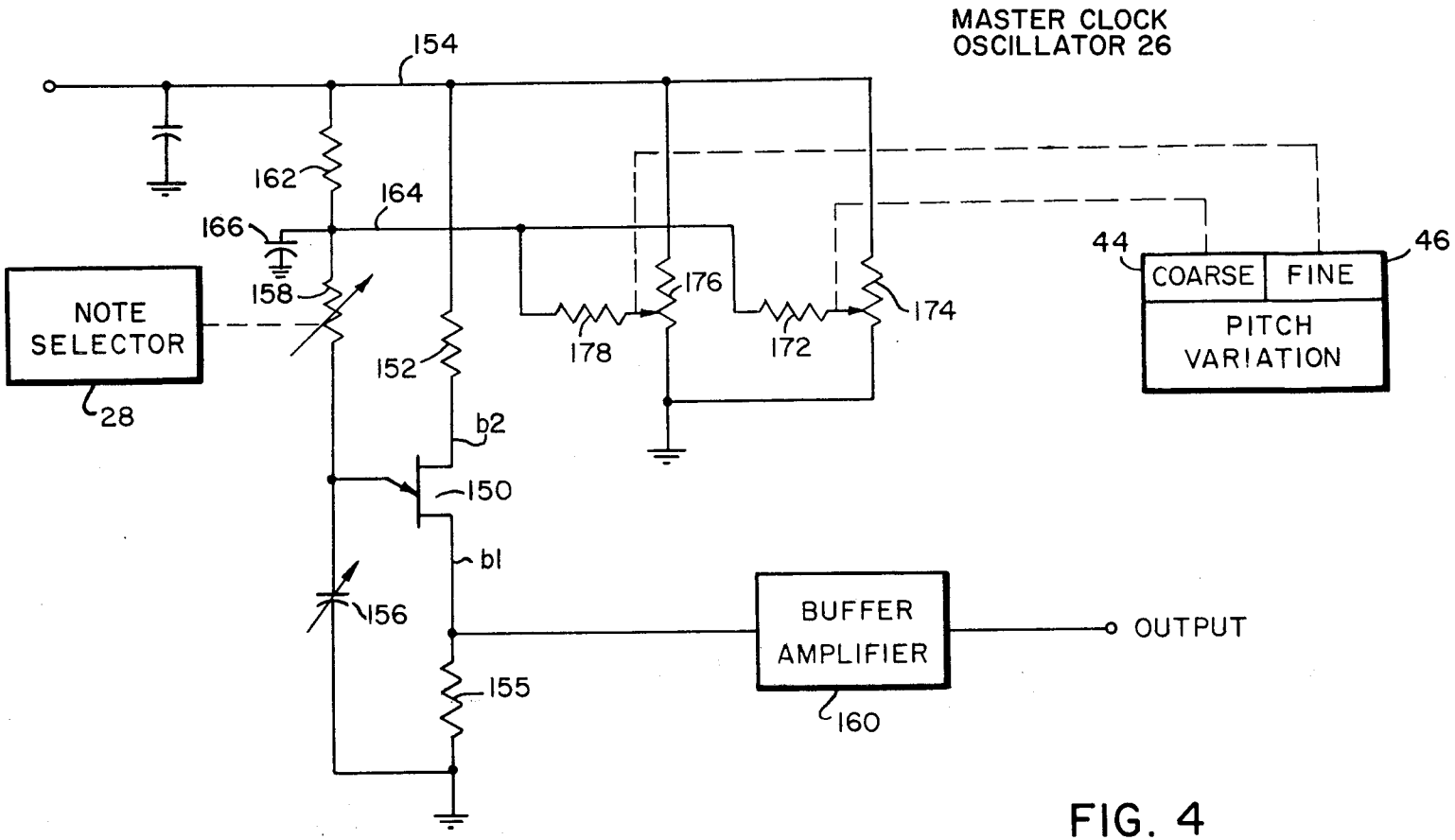
FIG. 4 is a detailed schematic of another portion of the circuit shown in FIG. 1.

As shown in FIG. 4, the master clock oscillator 26 comprises a unijunction transistor 150 in a relaxation oscillator circuit. A temperature-compensating resistor 152 connects "base 2" to a conductor 154 from a power supply. An output resistor 155 is between "base 1" and ground. Two elements in a timing circuit generally control the oscillator frequency — a variable capacitor 156 and a variable resistor 158.

To set the oscillator initially, the capacitor 156 is adjusted so that the oscillator 26 generates its highest required frequency. This is done with the resistor 158 at a minimum value. Usually the resistor 158 comprises a switched resistance ladder network or other network which enables the frequency for each setting of the note selector 28 to be adjusted independently. During calibration, the frequencies are adjusted for the correct mathematical relationship. A buffer amplifier 160 couples the signal from the output resistor 155.

The capacitor 156 and resistor 158 constitute two distinct means for varying the frequency of the oscillator 26. The oscillator 26 includes a third means for independently varying frequency. As known, the unijunction transistor 150 discharges when the emitter voltage reaches a threshold which is substantially constant percentage of the voltage between the bases. The time it takes the capacitor voltage to reach that threshold is a function of the resistor and capacitor values and the voltage applied to the timing circuit.

In the oscillator 26 in FIG. 4, this voltage appears across a bypass capacitor 166 and is equal to the voltage on the conductor 154 minus the voltage across a resistor 162. The voltage across the resistor 162 depends on the current through it and the current has two components. A first component is constant for a given setting of the note selector 28 and depends upon the voltage on the conductor 154 and the series impedance of the resistors 162 and 158.

The second component is variable in response to the setting of the pitch controls. A conductor 164 carries this second component. As the pitch controls increase this component, the voltage drop across resistor 162 increases so the voltage across capacitor 166 decreases. As a result, the oscillator frequency decreases.

The remaining circuitry shown in FIG. 4 provides this variable second current component. A first resistor network comprising a resistor 172 couples the conductor 164 to the wiper of a potentiometer 174, the potentiometer 174 being energized from the conductor 154. Variations in the position of the coarse pitch control 44 offset the wiper arm from a normal position. Positioning the fine pitch control 46 similarly alters the wiper arm on a potentiometer 176 also energized from the conductor 154. A resistor 178 couples this wiper arm to the conductor 164.

The qualitative effect of varying either wiper arm position is the same. The component values are chosen so that a given physical displacement of the coarse pitch control 44 produces a larger offset than the same displacement of the fine pitch control 46. Therefore, the following discussion relates only to the operation of the coarse pitch control 44.

Two relationships exist in this circuit. First, as apparent, the voltage on the conductor 154 is greater than the voltage on the conductor 164. Secondly, resistor 172 is at least an order of magnitude larger than resistor 162.

At a zero voltage offset position, there is substantially a zero voltage drop across the resistor 172 so only the first current component flows through the resistor 162. If the coarse pitch control 44 is moved, the second current component from the conductor 164 changes the voltage across the resistor 162 and the capacitor 166.

Both pitch controls vary the frequency as a percentage of the base frequency, so these controls can be calibrated in "musical cents" difference to raise or lower the resulting frequency, assuming that the oscillator is calibrated with the potentiometers 174 and 176 at their mid-points. One "musical cent" or "cent" is 1/100th of a semitone.

The tuning aid shown in FIG. 1 is sensitive and accurate. Tests show that the display has visible motion when the phase shift is less than 10°, with the accuracy being dependent upon the time the tuning aid senses the tone and the stability of both the tone and note. This means that the tuning aid senses a frequency difference which produces less than a 10° phase shift over the interval the note signal exists. When operated from a regulated battery power supply, the tuning aid is very stable. Tests against a tuning fork show no displacement after 10 seconds of tone. This increased sensitivity and stability have enabled me to analyze how pianos are tuned conventionally and to find a new way to tune a piano, as described later.

c. Input Circuit

Figures 5A, 5B:
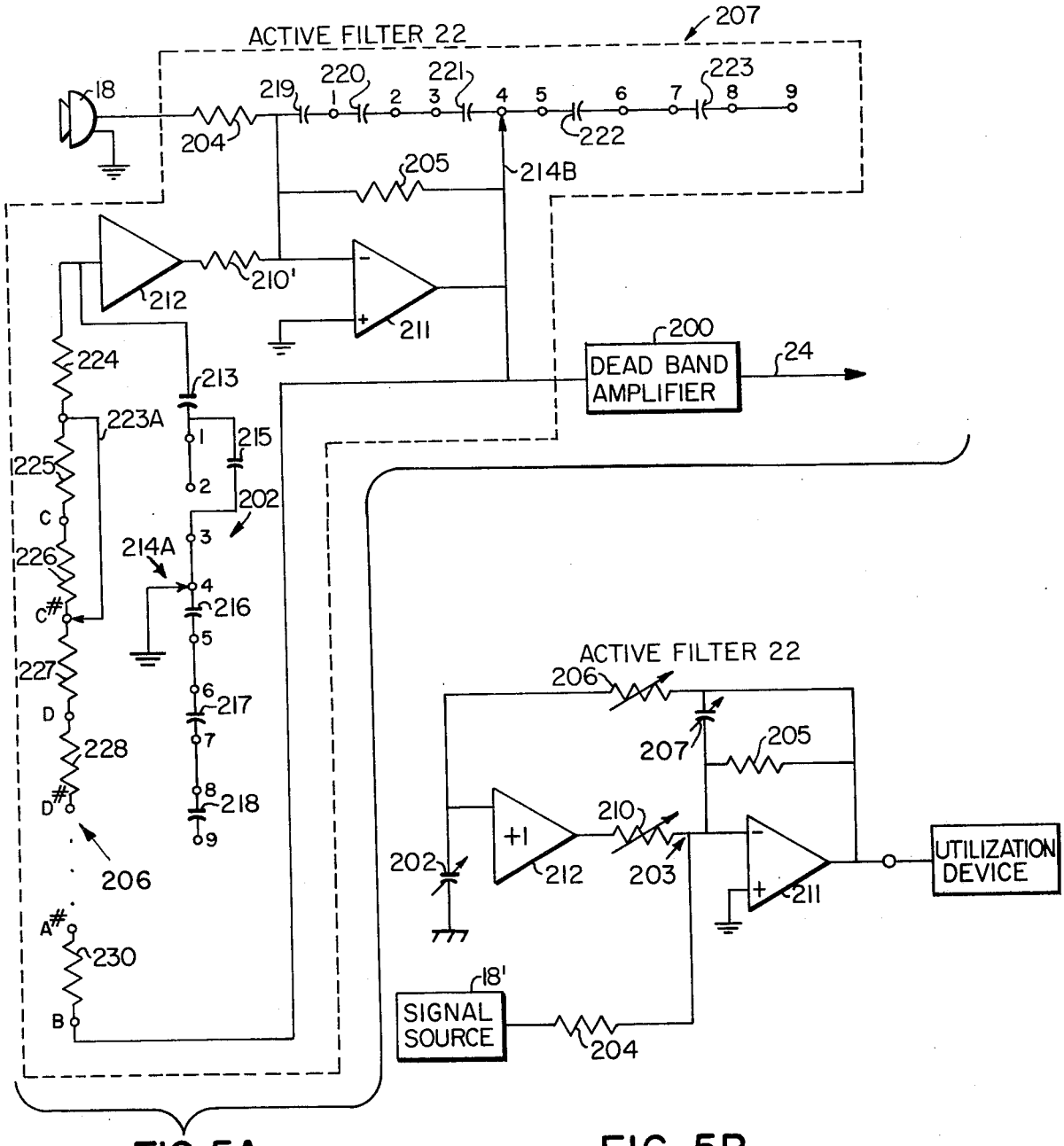
FIG. 5A shows a specific embodiment of the input circuit in FIG. 1.
FIG. 5B shows a simplified block diagram of the filter circuit in FIG. 5A.

FIG. 5A shows a specific embodiment of the input circuit 12 that does not require a preamplifier and in which the active filter 22 passes signals from the microphone 18 to the conductor 24. A deadband amplifier 200 in series with the conductor 24 tends to eliminate noise. Deadband amplifiers used for this purpose are known in the art. Although the amplifier 200 tends to affect the waveform of a note being sensed, the squaring circuit 56 in FIG. 2 provides the necessary shaping to obtain a good waveshape.

FIG. 5B is a simplified schematic of an active bandpass filter which is suited for use in the input circuit. This filter comprises a first time constant network including a variable capacitor 202 and a variable resistor 206 and a second time constant network including a variable capacitor 207 and a variable resistor 210. An amplifier, with gain determined by a feedback resistor 205, produces an output signal. The output signal is also fed back to a (−), or inverting, input of amplifier 211 through the capacitor 207. The first time constant network is also a feedback circuit in which the capacitor 202 is grounded. A unity gain amplifier 212 couples a signal developed across the capacitor 202 to the (−), or inverting, input of the amplifier 211 through the resistor 210. A signal source 18', such as the microphone 18 and preamplifier 20, in FIG. 1, provides input signals to the (−), inverting, input of the amplifier 211.

This filter is an active bandpass filter which enables the resonant frequency to be varied without altering Q as discussed in U.S. Pat. No. 3,789,963, identified previously. FIG. 5A shows a modification which also is a tunable bandpass filter. The Q does vary in this circuit, but within acceptable limits.

Looking at FIGS. 5A and 5B, amplifiers 211 and 212 correspond. Capacitor 202 in FIG. 5B comprises a capacitor 213, a switch 214A and capacitors 215, 216, 217 and 218. The capacitors switched in circuit to form the capacitor 202 for each octave position are shown in the CAPACITANCE TABLE. These individual capacitors connect in series.

CAPACITANCE TABLE

| Switch Octave Position | Series Capacitors | |
|---|---|---|
| | Capacitor 202 | Capacitor 207 |
| 1 | 213 | 219 |
| 2 | 213 | 219,220 |
| 3 | 213,215 | 219,220 |
| 4 | 213,215 | 219,220,221 |
| 5 | 213,215,216 | 219,220,221 |
| 6 | 213,215,216 | 219,220,221,222 |
| 7 | 213,215,216,217 | 219,220,221,222 |
| 8 | 213,215,216,217 | 219,220,221,222,223 |
| 9 | 213,215,216,217,218 | 219,220,221,222,223 |

Similarly, the capacitor 207 comprises another portion 214B of the switch and capacitors 219, 220, 221, 222 and 223, which are also switched according to the CAPACITANCE TABLE.

Switch portions 214A and 214B are mounted on a single shaft and constitute 2 parts of the octave selector 30. A third switch portion controls the frequency divider 32 (FIG. 1) as known in the art.

Note selection is provided by a switch section 223A which is part of the note selector 28. This switch section 223A varies the value of resistor 206 in FIG. 5B. In FIG. 5A, the resistor 206 includes a series of resistors including a resistor 224 and, under the control of the switch 223A, other resistors including resistors 225, 226, 227, 228 and 230. There is one such resistor for each note in an octave.

It is not necessary to make the resistor 210 variable; resistor 210' in FIG. 5A has a fixed value. Thus, the active filter 22 is a tunable bandpass filter with a Q greater than 10. Positioning the note selector 28 and octave selector 30 selects the filter resistors and capacitors that determine a specific resonant frequency. Only signals within the selected passband of the filter are coupled to the deadband amplifier 200.

d. Tuning Method

Piano tuners use different tests as they tune a piano to compensate for stretch. Each tuner, however, uses the same tests as he tunes each piano. Generally, therefore, the frequency deviation of a given note from its theoretical value after it is tuned is rather consistent from one piano to another and repeatable as to a given piano. With my tuning aid, a tuner could determine the curve for each piano once and then use the tuning aid and curve to retune the piano. Different curves are necessary because each piano has a characteristic stretch and is unique.

I am able to tune each piano to a custom deviation curve without the necessity for actually measuring the curve. Normally, a tuner starts with a reference pitch (e.g., 440 Hz) from a tuning fork or like unit. With my method, the tuner calibrates the tuning aid with this reference note by adjusting the pitch controls until the display is stationary. Then he adjusts the string tension for the same note in the lower octave [e.g., an A(220) note] until its second partial is at the reference frequency. If the tuner then adjusts the octave selector to the next lower octave and the pitch controls to stabilize the display, the pitch control movement indicates the characteristic stretch for the temperament octave of that piano.

Now the temperament octave is tuned by apportioning the stretch equally over the 12 semi-tone intervals. That is, if the lower note is in tune and the piano has the characteristic stretch of 4 cents (4% of a semitone), the next higher semitone is one-third of a cent sharp and each successive semitone is set sharp by an additional one-third of a cent. These small variations are easily obtained with my tuning aid because the percent change in frequency of a given note varies linearly as the angle of rotation of the potentiometer shaft. In one embodiment, for example, it is possible to set the pitch control 46 to within 0.1 cent. This procedure represents a linear apportionment. Still better tuning seems to occur with a weighted apportionment in which successive notes in the lower portion of the octave are spread slightly less than those in the upper. As with equal apportionment, however, the cumulative stretch is the same.

Once the temperament octave has been tuned, successive notes in the octave or in other octaves are also tuned. Generally, having the tuned A(220) and A(440), for example, one might tune the A(880), A(1760) and A(3520) notes in succession. The A(880) note may then be tuned by setting the tuning aid to monitor an A(1760) frequency and calibrating it to the fourth partial of the A(440) note. The A(880) note is then tuned for zero display rotation. When this occurs, the fourth partial of the A(440) note and the second partial of the A(880) note are in tune. As a tuner moves up the scale, he reaches a point at which the fourth partials are very weak. At this point, the procedure is modified by tuning a note [e.g., an A(3520) note] after the tuning aid has been calibrated to the second partial of a lower note [e.g., an A(1760)]. This procedure assures that each note is tuned with just the right amount of stretch to make octave intervals sound in tune.

For lower octaves, I calibrate the tuning aid to the second partial of a tuned note and then adjust the lower octave note, thereby comparing the second and fourth partials. As the tuner reaches lower notes, the strings generate less fundamental output. However, third, fourth, sixth and eighth partials become strong. Therefore, in the low bass a tuner may elect to use the tuning aid to align the fourth partial of a previously tuned note and the eighth partial of the note being tuned. Again, this procedure stretches the octaves by just the amount necessary for them to sound in tune.

Third and sixth partials may also be used. In this case, to adjust an A(55) note, the tuner sets the tuning aid to E(330), calibrates it to a tuned A(110) note and adjusts the A(55) note. In this manner, the tuner matches the sixth partial of the A(55) note and the third partial of the A(110) note.

As apparent, different piano tuners may alter the method of using my tuning aid. Furthermore, the tuning aid is not limited to monitoring audio frequencies. The detector 36, low-pass filters 40 and display 42 effectively sense and display frequency differences. Sensitivity is independent of the frequency being measured, within the frequency limits imposed on on the individual circuit components. As a result, the detection circuit 16 in FIG. 1 is useful for adjusting any variable frequency source to a standard.

Modifications

There are several possible modifications for the detection circuit 16. At very high frequencies, the sensitivity to frequency differences can be decreased by a frequency divider in each input to the detector 16. For example, if both inputs are at the same frequency and both are divided by 4, the display turns off at a 100 Hz difference, rather than 25 Hz. Alternatively, a sequence memory circuit may monitor the output from low-pass filters 40. In the specific structure shown in FIG. 2, the output sequence of 40-4, 40-3, 40-2, 40-1 indicates the note is flat; a sequence 40-1, 40-2, 40-3, 40-4, a sharp note. The memory circuit would energize one or two lights to display the sequence direction.

Figure 6B:
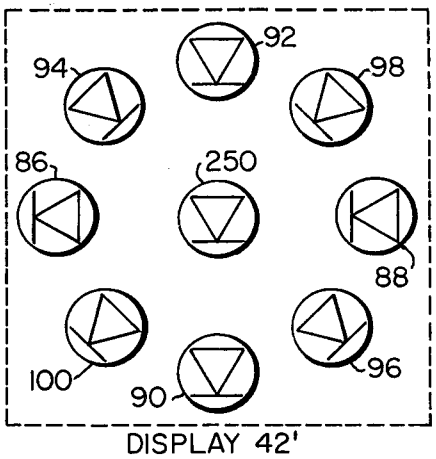
FIGURE 6B shows how this modification alters the display arrangement in FIG. 2.
Figure 6A:
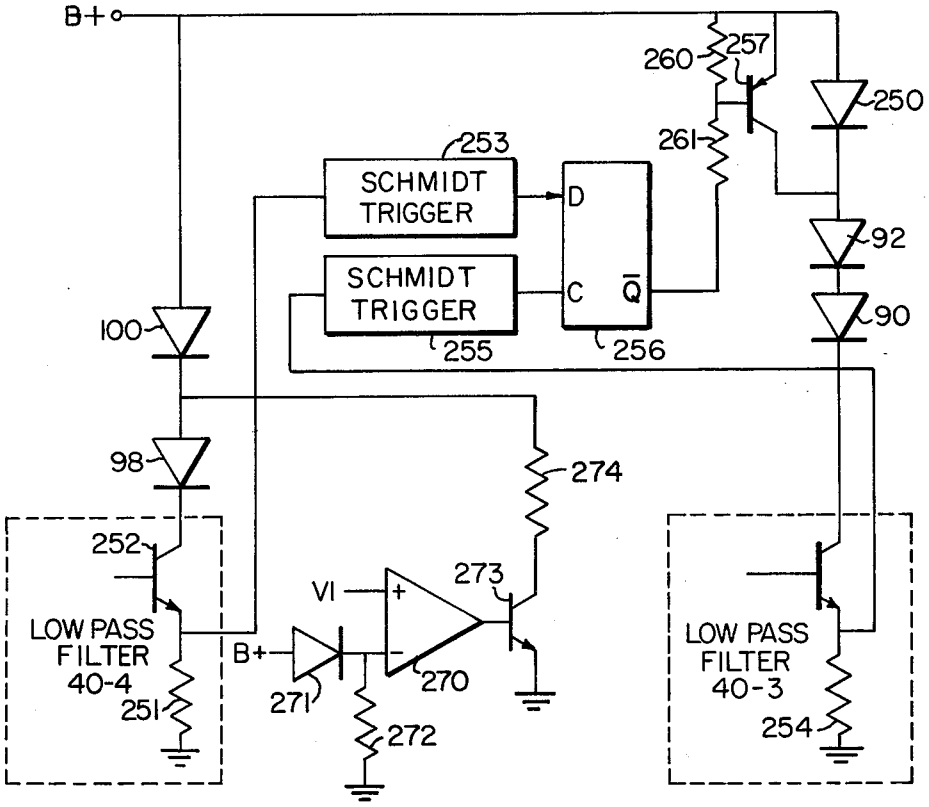
FIG. 6A is a schematic of a modification which can be made to FIG. 2.

Such an arrangement is shown in FIG. 6A. A light-emitting diode 250 is in series with two other light-emitting diodes, 90 and 92, and, is physically positioned at the center of the ring in FIG. 6B. When the display is persistent, the light emitting diode 250 is on when the note being tuned is sharp. It is off when the note is flat. When lit, the current through the diodes 90 and 92 is about the same whether diode 250 is lit or not, so all have the same apparent brightness as each other and as other diodes in the display. When the display appears as a rotating light bar, the diode 250 lights with the diodes 90 and 92 if the note being tuned is sharp.

With the above-mentioned sequences, a control circuit connects to low pass filters 40-3 and 40-4. Specifically, an emitter resistor 251 in filter 40-4 produces a voltage which varies in accordance with the voltage at the base of the transistor 252.

A schmidt trigger circuit 253 is one form of a conditioning and shaping circuit. It receives the emitter resistor voltage and produces a square wave output which is a ONE during a conductive interval.

Similarly, an emitter resistor 254 in the low pass filter 40-3 and a Schmidt trigger circuit 255 produce a logic ONE signal during the entire conductive interval for the diodes 90 and 92.

The outputs from the Schmidt triggers 253 and 255 are always displaced 90° and are applied to the D and C inputs of a flip-flop 256. As known in the art, such a flip-flop assumes the state of a signal at the D input which exists at the time of a signal transition at the C input. In this circuit, that transition is the rising edge of the pulse from the Schmidt trigger 255 which occurs just as the diodes 90 and 92 turn on.

Diodes 98 and 100 are either fully on or completely off during that transition. If they are off, the bar is rotating clockwise and the note is sharp. The output of the Schmidt trigger 253 is a logical ZERO signal so the flip-flop 256 clears and a $\overline{Q}$ output goes to a logical ONE level (which is assumed to be a positive voltage). Resistors 260 and 261 constitute a voltage divider between a B+ voltage source and the $\overline{Q}$ output. The values are selected so clearing the flip-flop 256 open circuits a shunt represented by a PNP transistor 257 connected across the diode 250. As a result, the diode 250 is switched into the circuit and lights simultaneously with diodes 90 and 92.

On the other hand, if the note is flat, the diodes 98 and 100 will be on when the diodes 90 and 92 turn on. In this case, the flip-flop 256 sets and the $\overline{Q}$ output goes to a low voltage (e.g., 0 volts). This closes the shunt (i.e., the transistor 257) and limits the voltage drop across the diode 250 so that it cannot turn on. Thus, the diode 250 positively and qualitatively indicates whether a note is sharp or flat.

As also shown in FIG. 6A, the display can be modified to visually indicate low supply voltage. This is especially helpful when a battery supplies the B+ voltage. Specifically, a battery monitor circuit comprises an amplifier 270 which receives a regulated voltage at a (+), or noninverting, input. The B+ voltage is coupled to the (−), inverting, input through a diode 271. An internal resistor, or an external resistor 272 if necessary, provides a current path so the (−), inverting, input to the amplifier is about one-half volt below the actual battery voltage.

Under normal conditions, the negative input causes the amplifier 270 to bias an NPN transistor 273 off. However, when the battery voltage reaches the V1 voltage plus the drop across the diode 271, the amplifier turns on the transistor 273 and couples the diode 100 to ground through a current limiting resistor. As a result, the diode 100 (FIG. 6B) turns on and remains on, signaling low battery voltage. The point at which this occurs can be adjusted by varying the number of diodes in series with the diode 271. This is but one example of such a battery monitor circuit. Others are also possible.

Therefore, it is apparent that there are many modifications and alterations which can be made to my tuning aid, the specifically described circuits and my methods for tuning a piano. It is the object of the appended claims to cover all such variations and modifications as come within the true spirit and scope of the invention.

What I claim as new and desired to secure by Letters Patent of the United States is:

1. A tuning aid for musical instruments comprising:

A. an input circuit with means for detecting an audio signal in a selected range of frequencies and generating a note signal;

B. a reference circuit for transmitting a reference signal; and

C. comparison and display circuit means including:

i. means responsive to the reference signal for producing a plurality of spaced phase reference signals at a known frequency, said reference signals including a first phase reference signal, and a second phase reference signal that is other than a complement of the first phase reference signal, ii. a phase difference detector including a logical combination means connected to receive each phase reference signal, each of said logical combination means combining the note signal and corresponding phase reference signal for transmitting a logical output signal which has a duty cycle that varies in accordance with the phase relationship between the note signal and the corresponding phase reference signal, and iii. a plurality of display means, each display means responsive to one of the output signals for displaying the phase relationship between the note signal and the corresponding one of the phase reference signals, said plurality of display means providing a continuous display of the direction of and rate of the note signal phase change.

2. A tuning aid as recited in claim 1 wherein each of said display means comprises:

A. averaging means responsive to each logical output signal for generating an analog signal which varies as a function of the phase relationship between the note signal and a corresponding phase reference signal, and B. at least one lamp connected with said averaging means, said averaging means varying the intensity of a corresponding lamp whereby the lamps in all of said display means reach maximum intensity in a sequence and rate which depends upon the frequency difference.

3. A tuning aid as recited in claim 2 wherein said logical combination means comprise exclusive OR circuit means responsive to the note signal and the spaced phase reference signals.

4. A tuning aid as recited in claim 3 wherein a plurality of lamps are connected in series with each of said averaging means, said lamps being equally spaced on the circumference of a circle, at least two lamps in a series set being connected to each averaging means and said lamps being equiangularly spaced about the circle, each lamp set being evenly spaced around the circle.

5. A tuning aid as recited in claim 3 wherein each said averaging means comprises a low-pass filter connected to be energized by each output signal, each low-pass filter having a cut-off frequency substantially below the lowest frequency to be tuned.

6. A tuning aid as recited in claim 1 wherein said phase detector includes means for producing the complement of each logical output signal as an additional logical output signal and each said display means comprises:

A. averaging means responsive to a logical output signal for generating an analog signal which varies as a function of phase relationship between the note signal and the corresponding one of the phase reference signals, and B. a plurality of lamps electrically in series with said averaging means, all of said averaging means varying the intensity of the respective ones of said lamps whereby the lamps reach maximum intensity in a sequence and rate which depends upon the frequency difference.

7. A tuning aid as recited in claim 6 wherein said means for producing the spaced phase reference signals produces two signals and said plurality of display means includes four pairs of lamps equiangularly spaced on the circumference of a circle, each lamp in a pair being diametrically opposed and each pair of lamps being connected to a corresponding output from each of said averaging means.

8. A tuning aid as recited in claim 7 wherein each of said averaging means includes a low-pass filter having a cut-off frequency lower than the lowest frequency to be tuned.

9. A tuning aid as recited in claim 7 additionally comprising:

A. an other lamp,

B. a sequence monitor receiving two of the analog signals from said averaging means for generating a sequence signal, and C. means receiving the sequence signal for enabling said other lamp.

10. A tuning aid as recited in claim 9 wherein said other lamp is connected in series with one of said lamp pairs whereby said other lamp is energized with said pair for one sequence of the analog signals.

11. A tuning aid as recited in claim 7 additionally comprising:

A. a power supply

B. a monitor circuit coupled to said power supply for generating a warning signal in response to a low voltage condition in said power supply, and C. switch means connected to a lamp to energize said lamp in response to the warning signal.

12. A tuning aid as recited in claim 11 wherein said switch means is connected to a lamp in one of said pairs, said switch means turning on said one lamp continuously.

13. A tuning aid as recited in claim 1 wherein said reference circuit includes means for generating clocking signals and said spaced phase reference signal producing means converts the clocking signal into a pair of phase reference signals which are electrically in quadrature, said logical combination means comprising first and second exclusive OR circuits, said first exclusive OR circuit being energized by one of said phase reference signals and said note signal and said second exclusive OR circuit being energized by the other phase reference signal and the note signal.

14. A tuning air as recited in claim 1 additionally comprising note selector means wherein said reference circuit comprises variable oscillator means responsive to said note selector means for generating a clocking signal at a selected one of a plurality of frequencies in a range greater than the highest frequency note to be tuned and said input circuit frequency detecting means in responsive to said note selector means.

15. A tuning aid as recited in claim 14 additionally including octave selector means wherein:

A. said reference circuit comprises a divider means responsive to said octave selector means for dividing said oscillator frequency, and B. said input circuit frequency detecting means is responsive to said octave selector means.

16. A tuning aid as recited in claim 15 wherein said reference circuit comprises a unijunction transistor oscillator with a variable timing resistor and a variable timing capacitor, said oscillator additionally comprising:

A. a voltage source and resistor for coupling a normally constant voltage component to said timing resistor, B. a variable voltage source including means for varying the voltage therefrom, and C. summing means for combining the voltage components, the resulting total voltage being coupled to said timing resistor and capacitor whereby the timing resistor, capacitor and variable voltage source control the oscillator frequency.

17. A tuning aid as recited in claim 14 wherein said oscillator comprises:

A. a voltage responsive oscillator circuit,

B. a first voltage source for generating a constant voltage,

C. a second voltage source for generating a variable voltage component, and

D. means for summing voltage components from said first and second voltage sources whereby varying the voltage from said second voltage source changes the oscillator frequency.

18. A tuning aid as recited in claim 14 additionally including an octave selector, said input circuit detecting means comprising a tunable bandpass filter with first and second means for independently altering the resonant frequency of said filter, said note and octave selectors being connected to said first and second altering means, respectively.

19. A tuning aid as recited in claim 2 wherein:

A. said spaced phase reference signal producing means transmits a third phase reference signal that is at the same frequency as the other phase reference signals and that is other than a complement of the second phase reference signal, and B. each of said averaging means additionally comprises means for establishing an intermediate analog signal threshold level below which the corresponding lamp is off, the intensity of a lamp, when on, varying in accordance with the difference between the analog signal and the threshold signal level, the threshold signal level being selected so that at substantially any time at least a pair of analog signals turn on lamps in corresponding ones of said display means.

20. A tuning aid as recited in claim 7 wherein each of said averaging means additionally comprises means for establishing an intermediate analog signal level below which the corresponding lamps are off, the intensity of a lamp, when on, varying in accordance with the difference between the analog signal and the threshold signal level, the threshold signal level being selected so that at substantially any time at least a pair of analog signals turn on lamps in corresponding ones of said display means.

21. A tuning aid for use in tuning the pitch of a note in a musical instrument to a desired pitch, said tuning aid comprising:

A. an input circuit for generating a binary note signal in response to an audio signal produced by the musical instrument when the note is played, the audio signal having a frequency that represents the pitch of the note and that lies in a selected range of frequencies;

B. a reference circuit for transmitting a binary reference signal at a known frequency representing the desired pitch; and C. a detection circuit including:

i. detector means for producing a plurality of binary logical output signals, each of the output signals having a duty cycle that is variable in response to changes in the phase relationship between the binary note signal and binary reference signal, and ii. a plurality of visual display means, each said visual display means being energized by one of the binary logical output signals, said plurality of visual display means being energized in a sequence dependent upon changes in the phase relationship of the binary note and binary reference signals, said plurality of visual display means collectively constituting a display array that continuously displays the phase relationship between the binary note and binary reference signals thereby to indicate that the note is tuned to the desired pitch when the display appears to be stationary and to indicate that the note is sharp or flat with respect to the desired pitch when the display appears to move in a first or second direction, respectively, the direction being dependent upon the sequence of energization of said visual display means and the rate of movement being dependent upon the difference between the actual and desired pitches.

22. A tuning aid as recited in claim 21 wherein said visual display means comprise lamp means.

23. A tuning aid as recited in claim 21 wherein each said visual display means comprises lamp means oppositely disposed on the circumference of a circle, said lamp means being equiangularly disposed about the circumference.

24. A tuning aid as recited in claim 22 wherein each of said lamp means comprises a pair of light emitting diodes.

* * * * *

UNITED STATES PATENT AND TRADEMARK OFFICE

CERTIFICATE OF CORRECTION

PATENT NO. : 4,014,242

DATED : March 29, 1977

INVENTOR(S) : Albert E. Sanderson

It is certified that error appears in the above-identified patent and that said Letters Patent are hereby corrected as shown below:

Column 2, line 27, delete "those" and insert --these--
Column 5, line 46, delete the period "." and insert a comma --,--
Column 6, line 32, delete "flip-flop" and insert --flip-flops--
Column 6, line 44, delete "flip-flop" and insert --flip-flops--
Column 8, line 8, delete "reprsenting" and insert --representing--
Column 11, line 19, after "(-)," insert --or--

Column 13, line 27, before "Modifications" insert --e.--
Column 13, line 59, delete "schmidt" and insert --Schmidt--
Column 14, line 34, after "(-)", insert --or--
line 36, after "(-)", insert --or--
Column 16, line 44, delete "air" and insert --aid--
Column 16, line 51, delete "in" and insert --is--

Signed and Sealed this thirtieth Day of August 1977

[SEAL]

*Attest:*

RUTH C. MASON
*Attesting Officer*

C. MARSHALL DANN
*Commissioner of Patents and Trademarks*